US008693717B2

(12) United States Patent
Kasanmascheff et al.

(10) Patent No.: US 8,693,717 B2
(45) Date of Patent: Apr. 8, 2014

(54) METHOD FOR COMPENSATING FOR AN INTERFERENCE SOUND IN A HEARING APPARATUS, HEARING APPARATUS, AND METHOD FOR ADJUSTING A HEARING APPARATUS

(75) Inventors: Robert Kasanmascheff, Erlangen (DE); Ulrich Kornagel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 906 days.

(21) Appl. No.: 12/719,991

(22) Filed: Mar. 9, 2010

(65) Prior Publication Data

US 2010/0232622 A1 Sep. 16, 2010

(30) Foreign Application Priority Data

Mar. 12, 2009 (DE) ..... 10 2009 012 745

(51) Int. Cl.
*H04R 25/00* (2006.01)

(52) U.S. Cl.
USPC ..... 381/320; 381/94.2; 381/317

(58) Field of Classification Search
USPC ..... 381/312, 317, 318, 328, 71.6, 72, 74, 381/80, 81, 94.1, 94.2, 94.3, 123, 320
See application file for complete search history.

(56) References Cited

U.S. PATENT DOCUMENTS

| | | | | |
|---|---|---|---|---|
| 5,740,258 | A * | 4/1998 | Goodwin-Johansson | 381/72 |
| 2004/0125973 | A1 * | 7/2004 | Fang et al. | 381/318 |
| 2008/0130929 | A1 | 6/2008 | Arndt et al. | |
| 2009/0041260 | A1 | 2/2009 | Jorgensen et al. | |
| 2010/0105447 | A1 | 4/2010 | Sibbald et al. | |

FOREIGN PATENT DOCUMENTS

| | | | |
|---|---|---|---|
| EP | 1313417 | A1 | 5/2003 |
| EP | 1931172 | A1 | 6/2008 |
| EP | 2 023 664 | A1 | 2/2009 |
| JP | H04359297 | A | 12/1992 |
| WO | 0217836 | A1 | 3/2002 |
| WO | 2008090342 | A2 | 7/2008 |

OTHER PUBLICATIONS

Jiun-Hung Lin, "Evaluation of Speech Intelligibility for Feedback Adaptive Noise Cancellation Headset", International Conference in Biomedical and Pharmaceutical Engineering, 2006, ICBPE 2006, pp. 24-29.

* cited by examiner

*Primary Examiner* — Huyen D Le
(74) *Attorney, Agent, or Firm* — Laurence A. Greenberg; Werner H. Stemer; Ralph E. Locher

(57) ABSTRACT

A novel system prevents surrounding sound to enter through a hearing apparatus, for instance through a ventilation opening, and reach an eardrum of the wearer in the form of interference sound. Contrary to auditory accessories designed especially to protect against noise, it is not possible for many hearing apparatus to compensate for such an interference sound by means of active noise cancellation. The hearing apparatuses do not have the special components needed. No compensation sound signal can therefore form with a correct phase. In accordance with the invention, a compensation sound is only generated for a relatively narrow spectral band. This spectral band is determined as a function of a hearing ability of the wearer of the hearing apparatus and/or as a function of a spectral distribution of the energy of the interference sound or a sound producing the interference sound. The improvement is particularly suited to compensating for an interference sound in a hearing device.

11 Claims, 4 Drawing Sheets

METHOD FOR COMPENSATING FOR AN INTERFERENCE SOUND IN A HEARING APPARATUS, HEARING APPARATUS, AND METHOD FOR ADJUSTING A HEARING APPARATUS

CROSS-REFERENCE TO RELATED APPLICATION

This application claims the priority, under 35 U.S.C. §119, of German patent application DE 10 2009 012 745.3, filed Mar. 12, 2009; the prior application is herewith incorporated by reference in its entirety.

BACKGROUND OF THE INVENTION

Field of the Invention

The invention relates to a method for compensating for an interference sound in a hearing apparatus. The invention also relates to a hearing apparatus, which is configured so as to compensate for an interference sound. The invention relates further to an apparatus and a method for adjusting a hearing apparatus. The term hearing apparatus is understood here to mean in particular a hearing device. Furthermore, the term also includes other wearable acoustic devices such as headsets, headphones and suchlike.

Hearing devices are wearable hearing apparatuses which are used to supply the hard-of-hearing. To accommodate the numerous individual requirements, different configurations of hearing devices such as behind-the-ear hearing devices (BTE), hearing device with an external receiver (RIC: receiver in the canal) and in-the-ear hearing devices (ITE), e.g. also concha hearing devices or canal hearing devices (ITE—in-the-ear, CIC—completely in the canal) are provided. The hearing devices designed by way of example are worn on the outer ear or in the auditory canal. Furthermore, bone conduction hearing aids, implantable or vibrotactile hearing aids are also available on the market. The damaged ear is herewith either stimulated mechanically or electrically.

Primarily important components of the hearing devices include in principal an input converter, an amplifier, and an output converter. The input converter is generally a recording transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This main configuration is shown in the example in FIG. 1 of a behind-the-ear hearing device. One or a plurality of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is supplied by a battery 5 which is likewise integrated into the hearing device housing 1.

A sound detected by a microphone of a hearing device also contains partially interfering noises from the surroundings of the device wearer. These ambient noises can be attenuated in the microphone signal by the signal processing unit of a hearing device by means of a filter for noise reduction purposes. The filtered microphone signal can then be converted into a sound signal by a receiver of the hearing device, said sound signal being output into the auditory canal of the device wearer. It is in this way important for a sound from the surroundings also not to pass directly, i.e. on an acoustic path, from the surroundings into the auditory canal to the eardrum. Such a sound, which undesirably passes from the surroundings directly through a ventilation opening of an otoplastic into the auditory canal of the device wearer for instance, is referred to as interference sound within the scope of this invention. The ambient noises are again audible to the device wearer in the form of the interference sound, said ambient noises having been laboriously filtered out in the microphone signal of the hearing device.

An auditory accessory for air travel is known from the prior art, in which an ambient sound is compensated for by means of a compensation sound. To this end, an ambient sound is superimposed with the compensation sound in the auditory canal of a wearer of the auditory accessory. The compensation sound is in this way phase-inverse. It therefore balances out the pressure fluctuations in the auditory canal, which were produced by the ambient sound without the compensation sound. In other words, the ambient sound and the compensation sound mutually cancel one another out by means of superimposition. The compensation of a noise by means of a compensation sound is called active noise cancellation (ANC) or more generally active sound cancellation.

To be able to generate a compensation sound using an auditory accessory, special components, in particular special transducers, must be used. On the other hand, a system formed from the converters and a compensation filter has an excessively large group delay time. In other words, it is not possible to provide a compensation sound with a correct phase without the special components.

In hearing apparatuses, such as hearing devices for instance, no components which have been designed especially to form a compensation sound can be used. The components of hearing apparatuses must namely already be optimized in accordance with other factors. As a result, no system with the necessary group delay time can form for an active noise cancellation. In the case of an otoplastic of the hearing device, it is also generally not possible to heavily attenuate an ambient sound for instance, if this reaches an ear drum of a device wearer as interference sound through a ventilation opening of the otoplastic, a so-called vent. An attenuation in a vent would mean that the exchange of air enabled by the vent was also impaired between the surroundings of the device wearer and the auditory canal.

SUMMARY OF THE INVENTION

It is accordingly an object of the invention to provide a method for compensating for noise in a hearing aid which overcomes the above-mentioned disadvantages of the heretofore-known devices and methods of this general type and which helps reduce the perceptibility of an interference sound for a device wearer which penetrates his/her ear in a direct, in other words, acoustic fashion. The object of the invention is also to provide a corresponding hearing apparatus.

With the foregoing and other objects in view there is provided, in accordance with the invention, a method for compensating for an interference sound in a hearing apparatus. The method comprises the following steps:

determining a spectral band as a function of a hearing ability and/or a spectral distribution of an energy of the interference sound or of a sound producing the interference sound;

filtering an input signal of the hearing apparatus that represents a sound in a spectral band according to a transmission function for the sound on an interference sound path; and generating a compensation sound with the input signal in inverted and filtered form.

The hearing ability includes a subjective volume perception by a device wearer. Such a volume perception can be determined with psychoacoustic methods which are known per se. The hearing ability can however also concern a hearing threshold, such as can be determined with the aid of an auditory curve for instance.

The method enables a compensation sound to be generated for a hearing apparatus. A compensation does not take place for all frequencies, but instead only for frequencies in the spectral band, in which a device wearer, according to his/her hearing ability, hears particularly well, and/or in which a noise has particularly significant sound energy for instance. Such a spectral band can often be relatively narrow in respect of the overall range of audible frequencies. The method can also be configured for a compensation into several spectral bands.

The compensation sound can be generated in particular also without specially optimized device components. During filtering, an unfavorable group delay time, which is caused by the transducer of the hearing apparatus for instance, can if necessary be corrected by a group delay time of the filter, which is negative in the specific spectral band. Such a correction is impossible in the case of a broadband active sound cancellation.

The term interference sound path refers to the totality of all acoustic transmission paths, by way of which an ambient sound, or a significant portion thereof, can reach the eardrum of a device wearer from his/her surroundings, where it is then perceptible as interference sound within the meaning of the invention. The interference sound path does not include the transmission which is normally effected by the hearing apparatus in a partially electronic manner.

In the case of an unwanted penetration of ambient sound to the eardrum, the ambient sound is changed spectrally. This spectral change is described by a transmission function of the interference sound path. A transmission function of an interference sound path can be determined by a manufacturer for instance by means of measurements using methods known per se from the prior art.

By the input signal being filtered with a transmission function, which corresponds to the transmission function of the interference sound path in a specific spectral band, the filtered input signal for the spectral band has the same spectral properties as the interference sound. A further filtering of the input signal can naturally be provided within the scope of the invention, by means of which a transmission behavior of a microphone or a loudspeaker of the hearing apparatus can be balanced out.

By the filtered input signal being inverted during the filtering process or thereafter, a signal is produced, from which a sound which is phase-inverse to the interference sound, in other words a compensation sound, can be generated. The compensation property is ensured here by the inventive method, particularly in the specific spectral band.

If the spectral band is determined in the method as a function of the spectral distribution of the energy of the interference sound or of the sound producing the interference sound, an advantageous development results if the determination of the spectral band is repeated periodically or takes place continuously. A constant adjustment of the spectral band to the spectral distribution of the energy of the sound to be compensated enables this also to be compensated if an ambient noise changes rapidly in terms of its spectral composition.

A further advantage results if, for filtering purposes, a filter is selected from a plurality of predetermined filters or a filter is calculated as a function of the spectral band. A filter refers here to all parameters which are needed to configure a filter algorithm. These parameters of a filter algorithm are also known here as coefficients of a filter.

The provision of several filters which have already been calculated for different spectral bands, in which a compensation is to be enabled by means of the compensation sound, renders the effort in terms of calculating a compensation sound signal particularly minimal. Calculating a filter as a function of a spectral band enables a filter to be provided for any spectral band.

An advantageous development of the method results if, in the case of the filter, the transmission function is multiplied by a predetermined factor, said factor describing an influence on the transmission function in the specific spectral band, which an interaction of the hearing apparatus has with an ear of a user. The multiplicative factor enables the inventive method to be adjusted to a specific user of the hearing apparatus with very little effort.

With the above and other objects in view, there is also provided, in accordance with the invention, a hearing apparatus, comprising:

a processing device for providing a spectral band in dependence of a hearing ability and/or for determining a spectral band in dependence of a spectral distribution of an energy of an interference sound or of a sound producing the interference sound;

a filter device for filtering an input signal of the hearing apparatus, which represents the sound, in the spectral band according to a transmission function for the sound on an interference sound path; and a sound output device for generating a compensation sound with the input signal in filtered and inverted form.

The novel hearing apparatus according to the invention enables sound to be compensated in a specific spectral band without other functionalities of the hearing apparatus, such as, for instance a noise reduction or a ventilation through a vent, being impaired in the process.

In the instance that a spectral distribution of the energy of the sound can be determined with the processing facility of the hearing apparatus, an advantageous development results if the processing facility includes a filter bank. With a filter bank, the spectral distribution of the sound energy can be continuously redetermined at temporal intervals of a few milliseconds. The spectral band, for which a compensation sound signal is to be calculated by means of the filter facility, can thus be determined correspondingly quickly.

The hearing apparatus is advantageously developed such that the filter facility includes a recursive, linear filtering process. The use of a linear filter is advantageous in that less computing time is needed in order to calculate a compensation sound signal. A recursive filter is advantageous in that particularly few coefficients are needed in order to map a transmission function for the sound on an interference sound path, so that the calculation can be implemented with particularly few computing steps. A particularly minimal group delay time can also be achieved using a recursive filter.

It is also advantageous if the filter facility of the hearing apparatus includes an adaptive filter. This enables one and the same filter to be used for different spectral bands. The filter only needs to be adapted to the transmission function of the interference sound path prior to filtering in the corresponding spectral band.

Alternatively to an adaptive filter, it is also advantageous if a plurality of filters is provided in the filter facility, from which, for filtering purposes, one can be selected as a function of the specific spectral band. Calculating the filter, i.e. the parameters or coefficients, in advance enables the compensation sound signal to be calculated very quickly.

In the case of the hearing apparatus, the transmission function is advantageously formed from a spectral curve and a scaling factor. In this case the spectral curve describes the ratio of the influence of the interference sound path on the sound in a frequency and the influence of the interference sound path on the sound in another frequency. In other words, only the main form of the transmission function is effected by the spectral curve. The spectral curve and the transmission function may still differ here by a multiplicative factor. This multiplicative factor is the scaling factor.

The division is advantageous in that the hearing apparatus can be particularly easily adjusted to a user. While the spectral curve can namely be determined during the manufacture of the hearing apparatus by means of measurements, the spectral curve can be easily aligned to an actual transmission function, as results when wearing the hearing apparatus, such that only the scaling factor has to be determined when adjusting the hearing apparatus for a user.

Furthermore, there is provided, in accordance with the invention, a method of adjusting a hearing apparatus, which comprises:

determining a hearing ability;

selecting or determining a compensation filter for compensating for interference sound in dependence on the hearing ability; and configuring a filter of the hearing apparatus according to the compensation filter obtained in the selecting or determining step.

The compensation filter is preferably selected here such that a compensation sound can be provided in the spectral band, in which the user has a good hearing ability, by means of the compensation filter. A good hearing ability is, as already mentioned, understood to mean in particular enhanced volume sensitivity. The compensation can also take place for several spectral bands. A configuration can take place for instance in that parameters or coefficients of the compensation filter are stored in the hearing apparatus so that a filter unit of the hearing apparatus can filter the input signal accordingly.

The method is advantageously extended such that the determination of the compensation filter includes a calculation of coefficients as a function of the hearing ability and of a transmission function for a sound on an interference sound path. As a result, the hearing apparatus can be individually adjusted to a user in respect of a compensation of an interference sound.

The method is further advantageous if the configuration includes a transmission of the selected and determined compensation filter to the hearing apparatus. The selection or determination therefore takes place outside of the actual hearing apparatus. As a result, there is no reliance on the storage capacity and computing capacity of the hearing apparatus, when selecting or determining a compensation filter. A list with possible compensation filters for selecting and/or a comprehensive algorithm for calculating a compensation filter can be provided by devices provided especially herefor. Only the complete compensation filter has to be transmitted to the hearing apparatus.

Finally, there is provided, in accordance with the invention, an apparatus for adjusting a hearing apparatus, comprising:

a measuring device for determining a hearing ability;

a determination device for selecting or determining a compensation filter for compensating for interference sound as a function of the hearing ability; and an adjusting device for configuring a filter of the hearing apparatus according to the compensation filter selected or determined by said determination device.

This apparatus allows the method to be easily applied for adjusting a hearing apparatus.

The apparatus is advantageously developed by a plurality of predetermined compensation filters being stored in the determination facility, from which one can be selected as a function of the hearing ability. Consequently the apparatus can also be operated by persons who are not familiar with calculating compensation filters.

Other features which are considered as characteristic for the invention are set forth in the appended claims.

Although the invention is illustrated and described herein as embodied in a method for compensating for an interference sound in a hearing apparatus, hearing apparatus and method for adjusting the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
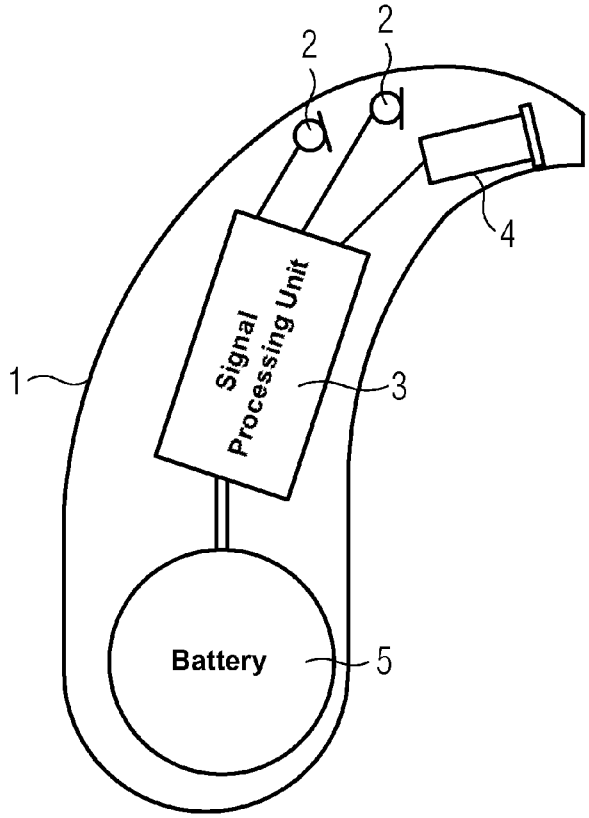
FIG. 1 PRIOR ART
FIG. 1 shows a schematic representation of a prior art hearing apparatus with components contained therein.
Figure 2:
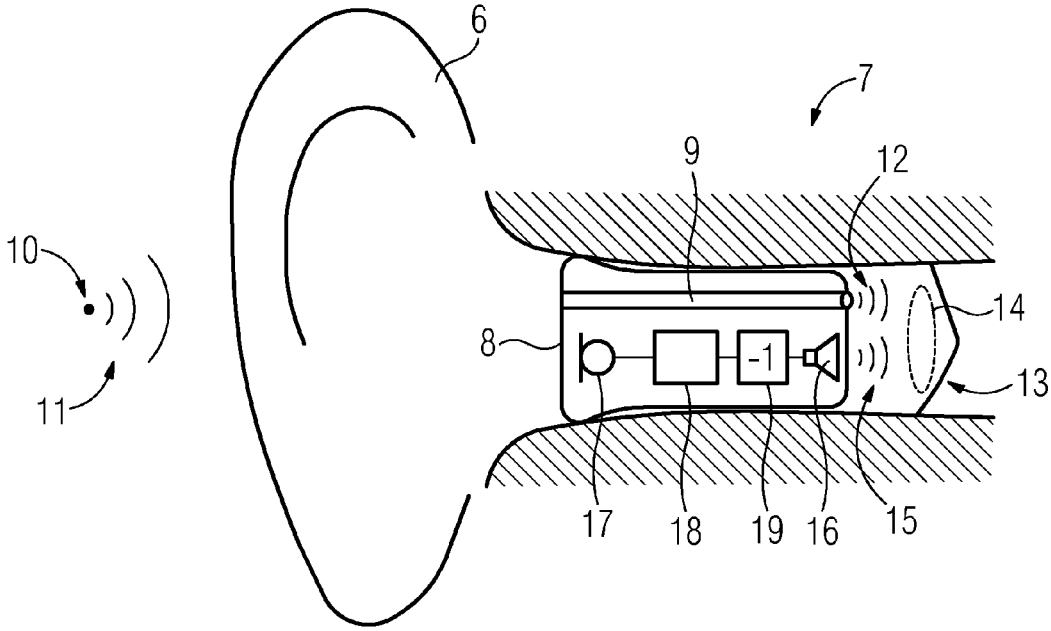
FIG. 2 shows a representation of an auditory canal with an in-the-ear hearing device located therein in accordance with an embodiment of an inventive hearing apparatus.

Referring now to the figures of the drawing that illustrate an exemplary embodiment of the invention and first, particularly, to FIG. 2 thereof, there is shown an ear with an auricle 6 and an external auditory canal 7. A hearing device 8 is inserted into the auditory canal 7. A vent 9 is formed in the hearing device 8, through which fresh air can flow from the surroundings of the ear into the auditory canal 7. Such a ventilation increases the wearing comfort for the user of the hearing device 8.

A sound source 10, which radiates an unwanted sound 11, in other words noise, to the auricle 6, is also located in the surroundings. The sound 11 can penetrate through the vent 9 into the auditory canal, where it can strike an ear drum 13 of the user as interference sound 12. The sound 11 therefore passes through the vent 9 to the ear drum 13 in a purely acoustic fashion.

In the example, the interference sound 12 shown in FIG. 2 also represents further interference sound, which penetrates the ear drum from the surroundings of the device wearer in a different fashion.

The interference sound 12 is attenuated in a region 14 upstream of the eardrum 13 by compensation using a compensation sound 15 to the extent that it is now barely audible for the user of the hearing device 8. The compensation sound 15 is superimposed with the interference sound 12 such that the sound formed by superimposing these sounds in region 14 has considerably less energy than the interference sound 12 alone. The sound formed from the two superimposed sounds nevertheless has significantly less energy across all frequencies in region 14 than the interference sound 12 alone. The compensation is only effected for such frequencies which can be perceived relatively well by the user of the hearing device 8 and in which the interference sound 12 has on the other hand relatively more energy. The totality of these frequencies forms a spectral band.

The compensation sound 15 is an integral part of a sound, which a receiver 16 of the hearing device 8 emits. The receiver 16 emits the compensation sound 15, because a compensation sound signal is additionally superimposed on a useful signal, which the receiver 16 converts into sound. The compensation sound signal is calculated from a microphone signal, which generates a microphone 17 of the hearing device 8. Within the meaning of the invention, the microphone signal is an input signal and represents the sound 11 from the surroundings of the user.

In order to calculate the compensation sound signal from the microphone signal, the microphone signal is filtered by way of a filter 18 of the hearing device 8 such that it has the same spectral properties in the above-mentioned spectral band as the interference sound 12. The compensation sound signal is then generated from the filtered microphone signal, in which compensation sound signal the filtered signal is inverted. For a curve of a graph of the filtered microphone signal, this means that its sign is inverse for each point on the graph. For a spectrum of the filtered microphone signal, this means that the phase is changed by 180° for each frequency of the spectrum. In the example, the inversion takes place by means of an inverter 19. The filter 18 and the inverter 19 work together as a compensation filter within the meaning of the invention.

The filter 18 and the inverter 19 can also be combined to form a compensation filter. The filter function of the filter 18 is then created such that the filtering and inversion processes take place together. A separate inverter is then not needed.

The filter 18 is a recursive, linear filter. It is consequently possible to provide a necessary group delay time of the filter in a specific spectral band. The filter 18 only reproduces the spectral change of the sound 11 when passing through the vent 9 and through the other points on the path into the auditory canal 7 for the spectral band mentioned. Allowance is made here for a microphone signal, which is to be processed by the filter 18, and which is to actually represent the sound 11, having been falsified by a transmission property of the microphone 17. Allowance is also made for a distortion also being effected by the receiver 16 when converting the compensation sound signal into the compensation sound 15. The filter 18 balances out this influence of the two transducers and further components of the hearing device.

The function of the hearing device shown in FIG. 2 may once more be summarized thus: for the user, the hearing device 8 is not only a hearing aid, but also acts like an active ear plug, i.e. it compensates for the interference sound 12, which reaches the eardrum 13 of the user for instance through the vent 9. To this end, the ambient sound 11 is recorded with the aid of the microphone 17 of the hearing device 8 and the spectral characteristics of the microphone is modified by means of the filter 18 and the inverter 19. The compensation sound is then generated from the filtered and inverted microphone signal (compensation sound signal) by means of the receiver 16. The superimposition of the sound 11, which unintentionally reaches the eardrum 13 as interference sound 12, with which the compensation sound 15, which the hearing device 8 outputs, results in the desired cancelling-out of the interference sound in the region 15 directly adjacent to the eardrum 13 of the user.

In the case of the hearing device 8, it is not possible to dimension the filter 18 such that it functions ideally for the entire audio frequency range. This is due to a hearing device not being designed exclusively for the purpose of the active noise cancellation. The components of the hearing device 8 which are used, in other words the microphone, the receiver, the housing mold and attenuating materials, are therefore not created such that they allow an active noise cancellation to be effected. The active noise cancellation in the hearing device 8 is thus restricted to a specific spectral band.

By suitably dimensioning the filter 18, it is possible to control the frequency band in which an active noise cancellation works particularly well and the frequency band and/or bands in which the active noise cancellation behaves less than optimally. The consequence is that the active noise cancellation reduces in certain frequency ranges and/or a sound amplification takes place instead of a sound cancellation in certain frequency bands.

In combination with the knowledge relating to a hearing loss of the user, the frequency band in which the active noise cancellation works particularly well is placed into the frequency range in which the wearer of the hearing device perceives an interference noise relatively clearly or loudly. Conversely, the artifacts which develop in frequency ranges with poor noise cancellation are masked by the hearing loss of the hearing device wearer.

Figure 3:
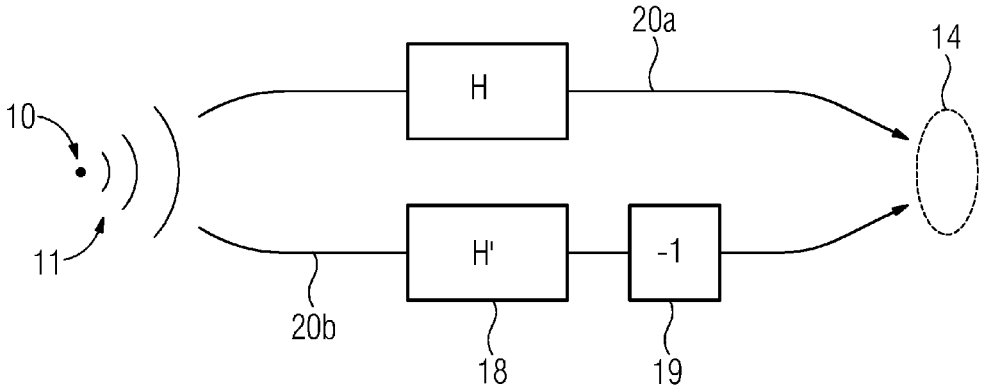
FIG. 3 shows a signal flow chart of a sound signal, as is produced in an embodiment of an inventive method for compensating for an interference sound.

Referring now to FIG. 3, there is shown once more, in connection with FIG. 2, how the signal of the sound 11 of the sound source reaches the region 14 in the auditory path of the user on an interference sound path 20*a* and on a signal path 20*b*. The interference sound path 20*a* represents the unwanted transmission of the sound 11 through the vent and along the remaining paths from the surroundings into the interior of the auditory canal. The sound 11 reaches the region 14 as interference sound via the interference sound path 20*a*. When passing through the vent and during transmission along the remaining paths, the sound 11 is changed in terms of its spectral properties. This is symbolized in FIG. 3 by a transmission function H of the interference sound path 20*a*.

The signal path 20*b* represents the path of the signal of the sound 11, as is formed by the electronic processing of the sound 11 in the hearing device shown in FIG. 2. The signal path 20*b* includes converting the sound 11 into a microphone signal, filtering the microphone signal by means of the filter 18 shown in FIG. 2 and the inverter 19 and generating the compensation sound, likewise shown in FIG. 2, by way of the receiver 16. The filter modifies the microphone signal in accordance with a transmission function H' of the filter 18.

The transmission function H' enables a sound to be generated in the region 14 for the specific spectral band, the sound having approximately the same spectral properties as the sound transmitted by way of the interference sound path 20*a*.

The degree of match is so great here that only barely audible artifacts develop in the spectral band during compensation. At best, the match is however perfect so that the artifacts do not develop.

The inverter 19 ensures that the signal filtered by the filter 18 in accordance with the transmission function H' takes on the properties of a compensation sound signal in the spectral band. The output signal of the inverter 19 is then converted into a compensation sound 15 by means of the receiver 16 shown in FIG. 2 and is likewise emitted in the direction of region 14. In region 14, the signals of the interference sound path 20*a* and signal path 20*b* therefore mutually cancel one another out in the spectral band in the described way.

Figure 4:
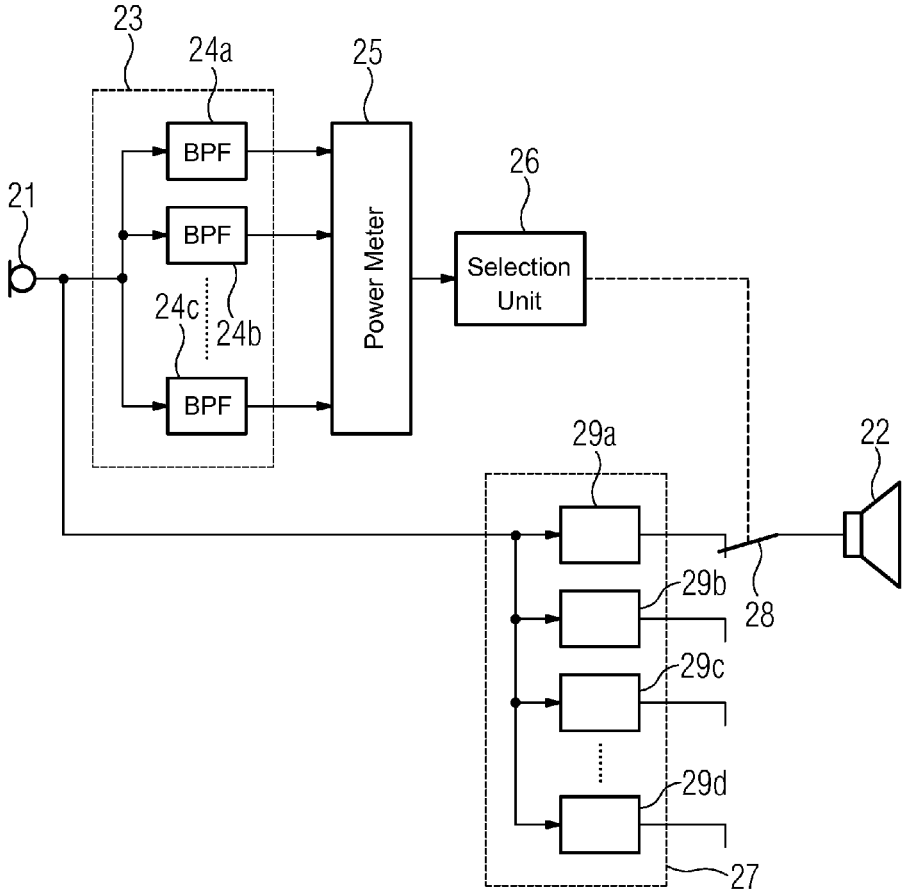
FIG. 4 shows a circuit diagram of a hearing device according to an embodiment of an inventive hearing apparatus.

The circuit diagram of an active noise cancellation in a hearing device shown in FIG. 4 shows how a compensation sound signal can be generated from an input signal, which is obtained by way of a microphone 21, the compensation sound signal then being converted into a compensation sound with a receiver 22.

The microphone signal of the microphone 21 is spectrally analyzed for this purpose, using a filter bank 23. Individual band pass filters 24*a*, 24*b*, 24*c* of the filter bank are shown in FIG. 4. The filter bank 23 has more than the three band pass filters 24*a*, 24*b*, 23*c* shown. For reasons of clarity, band pass filters which are not shown are symbolized by ellipsis symbols.

The signals at the outputs of the band pass filters 24*a*, 24*b*, 24*c* of the filter bank 23 are compared with one another by means of a power meter 25. An output signal of a band pass filter 24*a*, 24*b*, 24*c* reproduces the amount of energy available in a spectral band, for which the corresponding band bass filter 24*a*, 24*b*, 24*c* is permeable. On the basis of the output signals of the band pass filter 24*a*, 23*b*, 23*c*, the power meter 25 determines the spectral band in which a device wearer would perceive an interference noise at its clearest. Several spectral bands can also be combined.

For the determination of the spectral band, the power meter 25 does not use the division of the energy directly, such as can be read off at the outputs of the filter bank 23. A spectral distribution of the energy of the interference sound is calculated instead. To this end, the spectral distribution of the energy of the microphone signal, which is calculated by the filter bank 23, is initially weighted by the filter bank 23 with a spectrum of a transmission function for the interference sound path.

The power meter 25 may also be able to weight the information received by the band pass filters 24*a*, 24*b*, 24*c* with an auditory curve of a user such that the subjective volume perception of the user is taken into account for the individual spectral bands, which are represented by the band pass filters 24*a*, 24*b*, 24*c*. This may result in a spectral band, in which a relatively large amount of energy of the interference sound is located, consequently not being selected by the power meter 25, because the user of the hearing device has a poor hearing ability in this spectral band. Provision may also be made to also estimate the subjective volume perception by means of a psychoacoustic model.

Information concerning the selected spectral bands is transferred from the power meter 25 to a selection unit 26. The selection unit 26 configures a filter unit 27 such that the microphone signal of the microphone 21 forms a compensation sound signal for the spectral band selected by the power meter 25 after filtering by means of the filter unit 27. The configuration is symbolized in FIG. 4 in such a manner that the selection unit 26 acts on a selection switch 28. The selection switch 28 can toggle symbolically between the outputs of various filters 29*a* to 29*d*. As in the case of filter bank 23, not all the filters 29*a* to 29*d* available in the filter unit 27 are shown in FIG. 4. The filters (not shown) are in turn indicated by ellipses. The filter 29*a* is active in the switching state of the selection switch 28 shown in FIG. 4.

As already mentioned, the selection form shown in FIG. 4 by means of the selection switch 28 is only a symbolic representation of the procedure. Alternating between different filters 29*a* to 29*d* in the hearing device is actually enabled in that a filter algorithm of the filter unit 27 is configured by way of coefficients. The filter unit 27 of the microphone signal is thus filtered according to one of the filters 29*a* to 29*d*, but a corresponding set of coefficients must be transferred to the filter algorithm. The different sets of coefficients, which represent the filters 29*a* to 29*d*, are stored in a table. The selection unit 26 makes its selection herefrom. This selection, as already mentioned, is dependent on the determined spectral band and/or the spectral bands and is in the meaning of the invention therefore dependent on the spectral distribution of the energy of the microphone signal and if necessary also on the hearing ability of the user.

In the case of the filter unit 27, it is possible, by means of restriction to a relatively narrow spectral band, for the compensation to achieve a correct delay time for this band when processing the sound through the hearing device. It is accepted here that the compensation operates sub-optimally in other frequency ranges, in other words outside the spectral bands determined by the computing unit 25. This, however, is not perceived by the user.

The microphone signal is continuously spectrally analyzed by means of the filter bank 23. An optimal filter 29*a* to 29*d* is selected for the respective spectral distribution of the energy of the interference sound. The toggling between the coefficient sets can take place as a merging process in order to avoid toggling artifacts. The filter unit 27, as a filter algorithm, can also contain an adaptive filter as a whole or in part, instead of a table with sets of coefficients.

Figure 5:
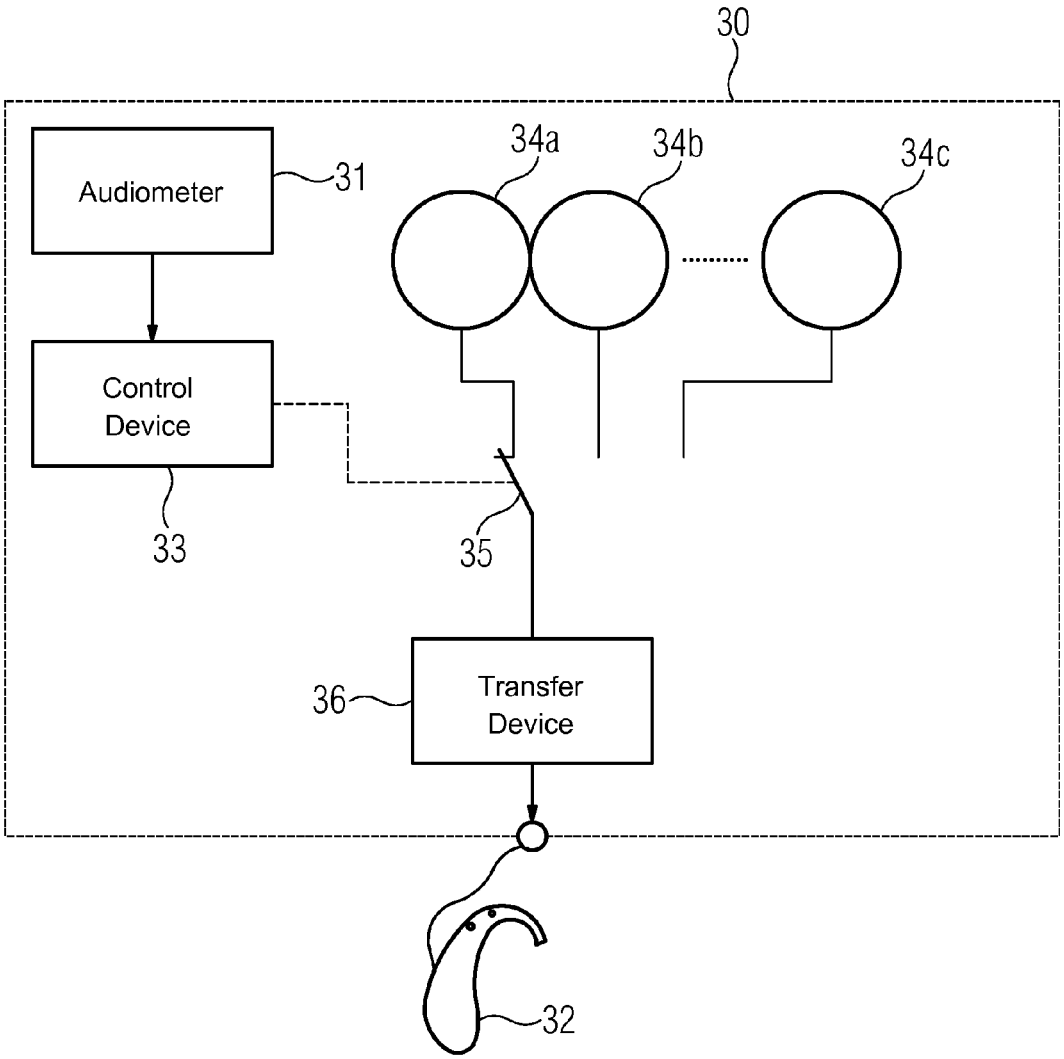
FIG. 5 shows a circuit diagram of a programming device for a hearing device according to an embodiment of an inventive apparatus for adjusting a hearing apparatus.

With the programming device 30 shown schematically in FIG. 5, a hearing loss of a wearer of a hearing device 32 is measured by means of an audiometer 31. The hearing loss is determined here in a frequency-dependent fashion. The hearing ability of the device wearer, which is determined by means of the audiometer 31, is indicated to an acoustician as an auditory curve on a screen (not shown in FIG. 5) by a control device 33.

Filters 34*a* to 34*c* developed by the manufacturer of the hearing device 32 are also stored in the control device. The filters are compensation filters within the meaning of the invention, with which an interferences sound can be compensated in different spectral bands for the hearing device 32, said interference sound being able to reach the eardrum of the wearer when wearing the hearing device 32 through an otoplastic of the hearing device 32 (not shown in FIG. 5).

Within the meaning of the invention, the filters can also be calculated in such a way that they effect an active noise cancellation for typical, previously determined hearing losses. Spectral bands can namely also be determined in advance for such typical hearing losses, for which compensation is needed. The auditory curve measured with the audiometer 31 can then be compared with the typical auditory curves in order to select a filter. The filter is selected for the typical auditory curve, which has the greatest similarity to the measured auditory curve.

Ellipsis symbols in FIG. 5 also symbolize that other filters exist in addition to the filters 34*a* to 34*c* which are shown. The filters are stored as sets of coefficients, which can be fed in to a corresponding filter algorithm. In accordance with FIG. 4, the selection of a set of coefficients from a list is also symbolized in FIG. 5 by the influence on a selection switch 35. The filter 34*a* is selected in FIG. 5 by the selection switch 35.

The set of coefficients for the selected filter is transmitted to the hearing device 32 by means of a transfer device or dubbing device 36. The set of coefficients is then stored in the hearing device 32. In the exemplary position shown in FIG. 5, it is the filter 34*a* that is dubbed to the hearing device.

Provision can also be made to store all coefficient sets of the filter 34*a* to 34*c* in the hearing device 32 itself and to transfer only the information relevant thereto to the hearing device, which is actually to use the filters 34*a* to 34*c*, by means of the control device 33.

When designing the filters 34*a* to 34*c*, it was not possible to make allowances for how much of an influence the special auditory canal of the wearer of the hearing device 32, in conjunction with the otoplastic of the hearing device 32, has when transmitting an ambient sound into the auditory canal. Provision can therefore be made for the transmission functions of the filters 34*a* to 34*c* only to describe a main spectral curve. In a subsequent step involving adjusting the hearing device 32 to the device wearer, a scaling factor is then determined with the aid of specimen signals, said scaling factor being stored in the hearing device. This scaling factor is applied multiplicatively to a filtered signal, so that an active noise cancellation is actually effected by the filtered and scaled signal.

Provision can also be made to use an auditory curve determined by means of the audiometer 31, in order to design a compensation filter individually for an auditory curve of a device wearer. This can take place by means of the acoustician controlling the corresponding programming device. Provision can however also be made for the determined auditory curve to be transmitted to a laboratory for hearing devices. A set of coefficients can then be calculated as a function of the transmitted auditory curve and a transmission function, which describes the transmission behavior of an interference sound path of a specific model of a hearing device, said set of coefficients once again being transmitted to the acoustician so that this transmits the set of coefficients into the hearing device.

Figure 6:
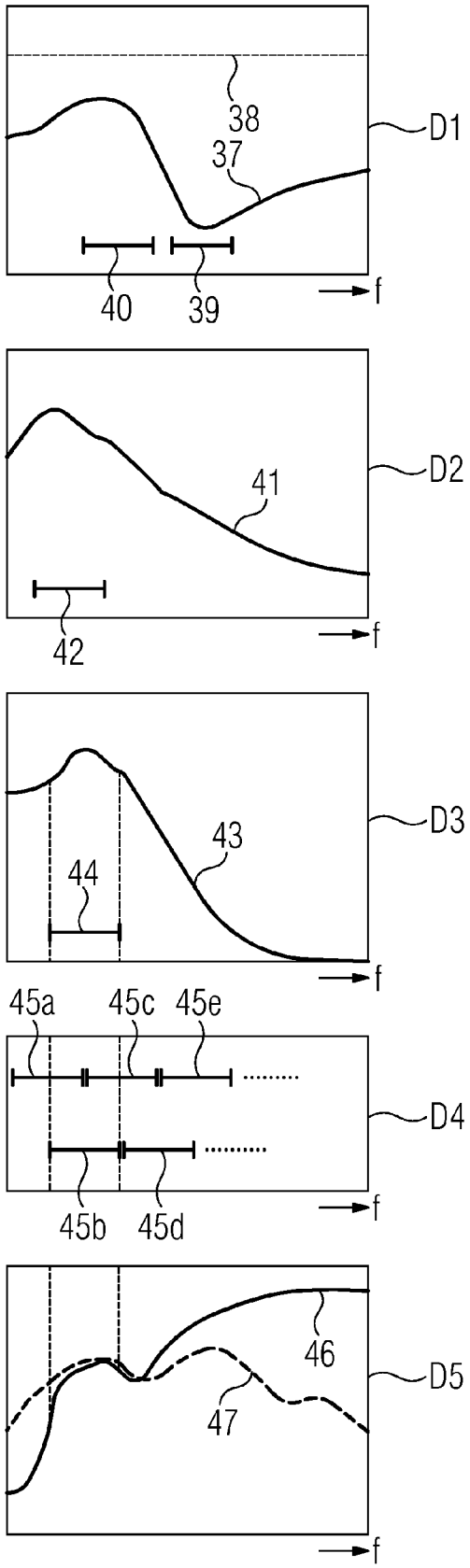
FIG. 6 shows a combination of diagrams with graphs showing several spectral variables, such as result in an embodiment of an inventive method for compensating for an interference sound.

The diagrams D1 to D5 shown in FIG. 6 show graphs of different variables as a function of a frequency f. The frequency range shown is an audio frequency range. Frequencies between 0 Hz and approximately 15000 Hz are shown here. The frequency axes of the individual diagrams D1 to D5 running horizontally in FIG. 6 are not divided linearly, so that the properties of the individual graphs can be represented more easily below. All diagrams D1 to D5 have the same non-linear division.

Diagram D1 shows an auditory curve 37 of a wearer of a hearing device, with the method being executed in the hearing device, said method including the diagrams D1 to D5 shown in FIG. 6. A comparison with an auditory curve 38 of a normal hearing person shows that the wearer of the hearing device 37 has a poorer hearing ability for all frequencies shown than a healthy person. In particular, a spectral band 39 exists, in which the wearer of the hearing device hears particularly badly. A spectral band 40 also exists, in which the wearer of the hearing device can hear comparatively well.

A spectral distribution 41 of the energy of a sound by way of the frequency is shown in Diagram D2. The sound originates from the surroundings of the wearer of the hearing device and is currently transmitted acoustically and unintentionally for instance through a vent of the hearing device as interference sound to the eardrum of the wearer of the hearing device. A spectral band 42 exists in the case of the distribution 41, in which the energy of the sound is particularly great.

The subjective perception 43 of individual frequencies of the sound has been calculated in Diagram D3 by the wearer of the hearing device. The subjective perception 43 results from a weighting of the distribution 41 of the energy of the sound with the auditory curve 37 of the wearer of the hearing device. The curve for the subjective perception 43 shows that a spectral band 44, for which the wearer of the hearing device perceives the sound particularly well, is between the region 42, in which the energy of the sound is concentrated, and the region 40, in which the wearer of the hearing device can hear relatively well.

According to the subjective perception 43, a set of coefficients of a compensation filter is determined in the hearing device, with which a compensation sound signal can be generated from a microphone signal, which represents the sound with the energy distribution 31. The compensation filter is selected here such that the compensation is effected particularly for the region 44. Provision can however also be made to determine the compensation filter only as a function of the auditory curve 37 or only as a function of the distribution 41 of the energy of the sound. If the compensation filter is only determined as a function of an auditory curve, the compensation filter must naturally only be determined once, when adjusting the hearing device.

Several coefficient sets are available in the hearing device, which can bring about a compensation in different spectral bands in each instance. In the diagram D4, those frequency ranges, i.e. those spectral bands 45*a* to 45*e*, for which a set of coefficients is stored in the hearing device, are entered in Diagram D5 for the individual sets of coefficient. The spectral bands, which belong to the further sets of coefficients, are not shown in the diagram in order to keep the diagram clear. This is indicated by dots in diagram D4.

As a function of the region 44, in which the sound can be particularly well perceived by the wearer of the hearing device, a set of coefficients, i.e. a compensation filter, is now selected. In the case shown in FIG. 6, the compensation filter is selected for the spectral band 45*b*. FIG. 6 shows the limits of the spectral band 45*b* both in diagram D3 and also in diagram D5 by means of dashed lines.

A transmission function 46 of said filter is shown in diagram D5, said filter belonging to the set of coefficients for the spectral band 45*b*. A transmission function 47 of an interference sound path is also shown in Diagram D5, by way of which the sound reaches the eardrum of the wearer as interference sound on an acoustic path from the surroundings of said wearer of the hearing device. As is apparent from a comparison of the two transmission functions 46 and 47, the two transmission functions almost match in the region of the spectral band 45*b*. It is consequently possible to generate a compensation sound signal from a microphone signal representing the sound in the spectral band 45*b* with a filter unit, which uses the corresponding set of coefficients.

Diagram D5 also shows that the limits of a spectral band, here spectral band 45*b*, do not have to be strict limits. The limits involve a transition range, in which a deviation of the transmission function 46 of the compensation filter from the transmission function 47 of the interference sound path gradually becomes greater. To achieve stricter limits, a threshold value can be determined for the deviation for instance, which can be determined for instance as a function of a perceptibility or measurability of artifacts in the case of the active sound cancellation.

Although the two transmission functions 46, 47 do not match in terms of the frequencies outside the spectral band 45*b*, the wearer of the hearing device consequently does not hear any interference sound in these frequencies. It can be inferred from the graph for the subjective perception 43 that he/she does not perceive a poorly compensated or even amplified interference sound in the frequencies outside the spectral band 45*b*.

The examples show how a compensation of an interference sound is enabled by means of the invention, even if the hearing apparatus is not designed for such a compensation. Less computing capacity is needed here to calculate a compensation sound signal.

The invention claimed is:

1. A method for compensating for an interference sound in a hearing apparatus, the method which comprises:

determining a spectral band as a function of a hearing ability and/or a spectral distribution of an energy of the interference sound or of a sound producing the interference sound;

filtering an input signal of the hearing apparatus that represents a sound in a spectral band according to a transmission function for the sound on an interference sound path; and generating a compensation sound with the input signal in inverted and filtered form.

2. The method according to claim 1, which comprises determining the spectral band as a function of the spectral distribution of the energy of the interference sound or of the sound producing the interference sound.

3. The method according to claim 2, which comprises periodically repeating the determining step or continuously determining the spectral band.

4. The method according to claim 1, which comprises filtering as a function of the spectral band by:

selecting a filter from a plurality of predetermined filters; or calculating a filter.

5. The method according to claim 1, which comprises, during filtering, multiplying the transmission function with a predetermined factor that describes an influence on the transmission function in a specific spectral band, which interaction of the hearing apparatus has with an ear of a user.

6. A hearing apparatus, comprising:

a processing device for providing a spectral band in dependence of a hearing ability and/or for determining a spectral band in dependence of a spectral distribution of an energy of an interference sound or of a sound producing the interference sound;

a filter device for filtering an input signal of the hearing apparatus, which represents the sound, in the spectral band according to a transmission function for the sound on an interference sound path; and a sound output device for generating a compensation sound with the input signal in filtered and inverted form.

7. The hearing apparatus according to claim 6, wherein said processing device is configured to determine a spectral distribution of the energy of the interference sound or of the sound producing the interference sound, and said processing device includes a filter bank.

8. The hearing apparatus according to claim 6, wherein said filter device includes a recursive, linear filter.

9. The hearing apparatus according to claim 6, wherein said filter device includes an adaptive filter.

10. The hearing apparatus according to claim 6, wherein said filter device includes a plurality of filters, and wherein one of said filters may be selected as a function of the specific spectral band.

11. The hearing apparatus according to claim 6, wherein the transmission function is formed from a spectral curve and a scaling factor.

* * * * *